US005501461A

United States Patent [19]

Donofrio

[11] Patent Number: 5,501,461

[45] Date of Patent: Mar. 26, 1996

[54] GOLF PUTTER HEAD

[76] Inventor: Matt Donofrio, Apt-G-Bamt Greenbrier CT, Clifton, N.J. 07012

[21] Appl. No.: 335,041

[22] Filed: Nov. 7, 1994

[51] Int. Cl.[6] ..... A63B 53/04

[52] U.S. Cl. ..... 273/171; 273/173; 273/169

[58] Field of Search ..... 273/167 C, 171, 273/169, 167 F, 167 H, 167 J, 78, 170, 173, 167 B, 167 G, 167 A

[56] References Cited

U.S. PATENT DOCUMENTS

| | | | |
|---|---|---|---|
| 3,399,898 | 9/1968 | Burkland | 273/167 F |
| 3,909,005 | 9/1975 | Piszel | 273/164.1 |
| 4,444,395 | 4/1984 | Reiss | 273/171 |
| 4,508,342 | 4/1985 | Drake | 273/167 C |
| 4,852,879 | 8/1989 | Collins . | |
| 4,872,684 | 10/1989 | Dippel | 273/167 C |
| 5,028,049 | 7/1991 | McKeighen | 273/167 J |
| 5,172,915 | 12/1992 | Flis | 273/167 C |

*Primary Examiner*—V. Millin
*Assistant Examiner*—Steven B. Wong
*Attorney, Agent, or Firm*—Rosenman & Colin

[57] ABSTRACT

A golf putter head having a body of a cylindrical shape with a convex ball contacting surface. The putter body generally has internal, tiered, cylindrical cavities, of varying diameters, extending equally outward from the center of mass, along the central axis of the putter head. The cavities are filled with weighing elements inserted into each of the two ends of the putter head. A groove aligned with the center is provided on the top surface of the putter head. The groove is filled with a highly visible indicator to facilitate the alignment of the center of the putter head face with the golf ball. End caps are inserted over the weighing elements in each end. The putter head provides a mounting hole in the top of the head, offset from center toward the heel and along the central axis of the head, for shafting.

16 Claims, 3 Drawing Sheets

GOLF PUTTER HEAD

FIELD OF THE INVENTION

This invention pertains to the construction and configuration of golf clubs and more specifically to golf club putters.

BACKGROUND OF THE INVENTION

Golf clubs are designed for use in hitting golf balls in a variety of ways, all of which require a sufficient applicable force and accuracy in order to most expeditiously propel the golf ball toward a designated ground hole goal or cup. Various golf clubs are used to provide various propelling functions. The initially used driver is designed for use in providing maximum lofted propulsion over a large distance (usually measured in hundreds of yards). Putters, used in the final approach to the hole, are at the opposite end of the golf spectrum wherein distance is subservient to extreme accuracy in causing the ball to be propelled across the ground and into the hole or cup.

The art of putting has eluded perfection by even the most ardent and talented golfers. Yet, the number of putts required to sink the ball often represents as much as half of the golfer's total score. Since a golfer is limited to a single putter over an entire round of play, the nature of the putter is important in permitting a golfer to play the best possible game.

Putting requires a high degree of skill and accuracy in which a properly designed club can enhance a player's natural and learned abilities. Numerous factors, which often involve trade-offs, are taken into account in the design of a club head for a putter and which relate to the putter's action during the swing and upon impact with the ball. These factors include moment of inertia, lateral dispersion, weight, club head material, shape of the striking face, shaft alignment, sighting means and face balance. Such factors relate to the rotational stability of the club during the swing, the maximum energy transfer from the club to ball, the balance, the resistance to twisting upon impact with the ball, even if hit off center, and the ability of the club to impart the maximal rotational energy on the golf ball to produce a natural rolling motion from point of impact.

The most common design for a golf putter includes a flat putting face, usually perceived as being necessary for best control. In other putters, putter heads have been designed with convex striking surfaces. These convex striking surfaces take advantage of the ability of a convex surface striking another convex surface (the ball) at a point below the equator of the ball (the putter diameter being less than that of the ball) to create a forward roll from the point of impact. A lack of swing balance is a problem with such putters. None of the available putters take into account substantially all of such factors in their design and structure. Thus, while putters, such as disclosed in U.S. Pat. No. 4,852,879 (with weighted ends), take into account longitudinal balance, there is no consideration given for overall weight balance during a swing or pendulum stroke.

It is accordingly, an object of this invention to provide a golf putter head encompassing the aforementioned design features to improve the putting facet of golf, including full balancing.

It is a further object of this invention to provide a golf putter head which virtually eliminates twisting upon impact with the golf ball and which reduces the putter head's sensitivity to twisting even during off center hits.

It is yet another object of the present invention to provide a golf putter head which will impart maximal rotational force to the golf ball, in the direction of the hole, from the point of impact, whereby the ground friction variable is reduced or eliminated with the creation of the rolling motion on the ball.

It is a still further object of the present invention to provide a golf putter head which is readily alignable with a golf ball for the accurate propelling thereof.

These, and other objects, features and advantages of the present invention will become more evident from the following discussion and drawings in which:

SHORT DESCRIPTION OF THE DRAWINGS

Figure 3:
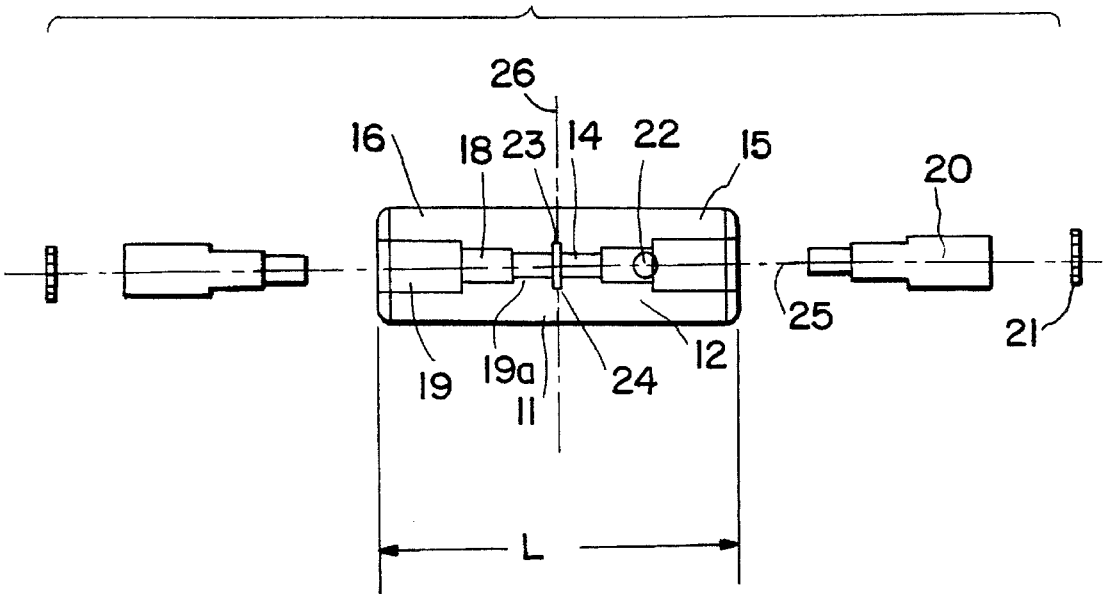
FIG. 3 is an exploded side view of the insertion of the weights into the ends of the golf club head.
Figure 3A:
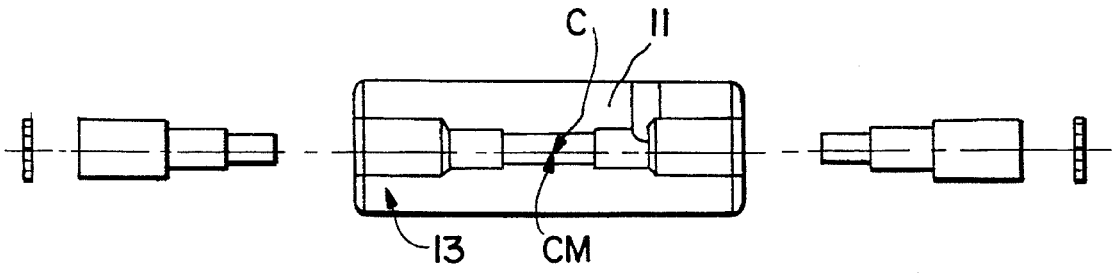
Figure 4:
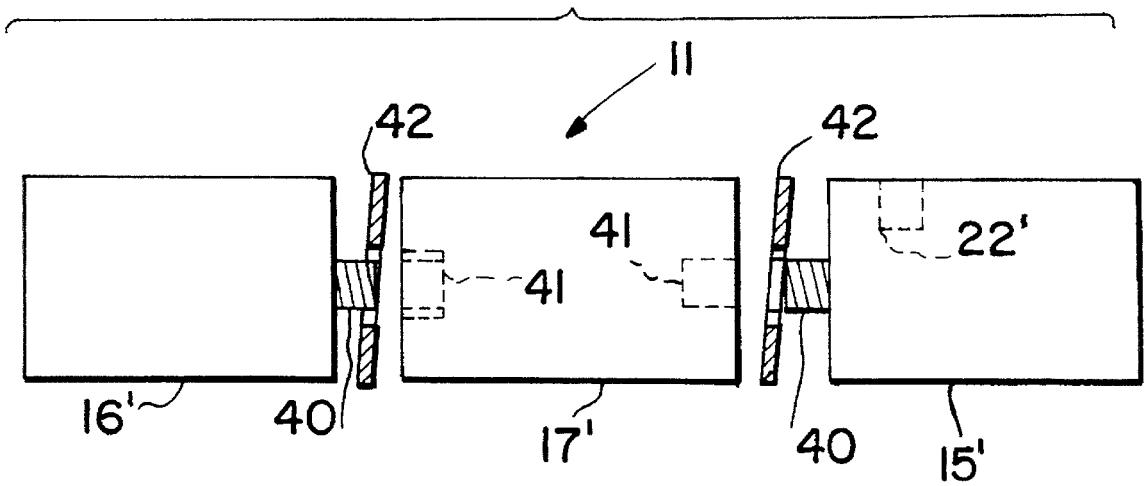
Figure 5:
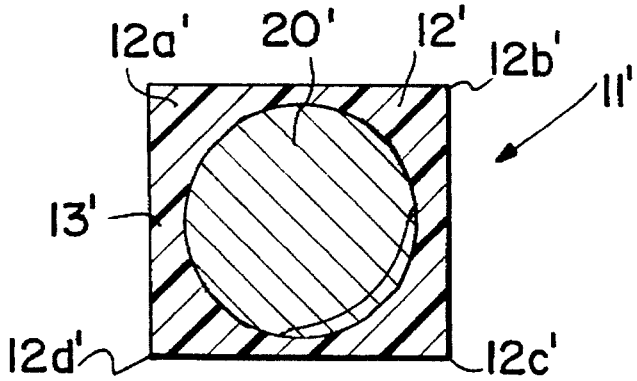

FIG. 3*a* is the view of FIG. 3, rotated 90° around the longitudinal axis;

FIG. 4 is a side view of a second embodiment of the cylindrical golf club head of the present invention; and FIG. 5 is an end sectioned view of a square golf club head, with a flat putting face, with cylindrical weight loading.

SUMMARY OF THE INVENTION

Generally the present invention comprises a golf putter head having an elongated configuration with a longitudinal central axis therethrough, wherein the weight distribution of the golf club head, at substantially all axial cross sectional positions thereof, is substantially concentrically evenly distributed around said axis. The golf putter head is comprised of weighted ends with the concentrically evenly distributed weight therein, for both longitudinal and axial balance.

DETAILED DESCRIPTION OF THE INVENTION

Most golf club putters are designed with a flat striking face, such as described in the aforementioned patent. However, in accordance with a preferred aspect of the present invention, the putter head is configured with a cylindrical shape and a curved striking surface in order to thereby take advantage of the ability of a convex surface striking a ball (having a second convex surface), slightly below the equator of the ball, to create a forward roll from the point of impact. In order to further exaggerate this effect, a high tech industrial plastic material, e.g., acetal, is preferred for the golf club head in order to provide a good feel and striking surface. A shaft mounting hole is provided in the top of the putter head, offset from the center for connection to the shaft.

The weighting, in accordance with the present invention (since plastic is too light for effective putting), is such that it be variable within industry standard guidelines, with a mass concentration of more than 50% in the two outer ends of the head in order to maximize moment of inertia and to minimize lateral dispersion. It is also preferred that a readily visible sight line be provided on the upper surface of the head adjacent the shaft, which sight line is centered and perpendicular to the putter head, whereby the head can be readily aligned with a golf ball for the desired path of travel.

In a preferred embodiment, the golf club head comprises a substantially cylindrical configuration with two cylindrical end sections of a heel (closest to the point of connection to a club shaft) and toe and a cylindrical center section therebetween. The heel and toe end sections comprise weight means wherein the end sections each comprise a greater mass or weight than that of the center section. The head is weighted for effective putting mass and the toe is correspondingly weighted for balance. In accordance with the present invention, the weight means in each of said end sections is evenly and concentrically distributed around the longitudinal axis of the cylindrical configuration of the putter head. To ensure proper balance, the ends sections are preferably equivalent in both size and weight. With the even concentric weight distribution, balance is not only maintained between the ends, as with many golf club heads, but is also maintained diametrically through the putter head for enhanced balance during the entire pendulum swing of a putter, even with change of putter head position relative to the ball.

To provide the diametrical balance, the golf club head may be comprised of three solid cylindrical sections which are attached, in line, such as by screw connections, with the outer ends being heavier than the center section, e.g., with metals of different densities and weights. For example, in a preferred embodiment, the putter head comprises a titanium center section with outer ends of heavier stainless steel.

Alternatively, the golf club head is comprised of a hard plastic outer cylindrical shell, such as a cored solid plastic having increasing larger diameter receptacle areas in the ends thereof into which weights are positioned. The weights are concentrically disposed within the shell along the longitudinal axis thereof. The weights are configured with circular cross sections, to provide the requisite even concentric cross sectional weight distribution. Examples of such weight configurations are cylinders, stepped cylinders, cones and the like, and where applicable, the greatest cross sectional weight is preferably positioned nearest the ends of the shell to reduce twisting. In such embodiment the plastic shell or body is hollowed out in varying diameters, coaxial with the central longitudinal axis, with the largest diameter being closest to the outer ends. This permits insertion of tapered weighting material (e.g. lead weights) to increase mass toward the ends.

In another embodiment, the outer shell, which is relatively light compared to the inserted weights, may be configured with an outer square, rectangular, or other similar configuration, provided that the weights therein are configured and positioned to provide the requisite substantially even concentric cross sectional weight distribution.

In all embodiments, it is important that the weight elements be snugly engaged with other elements. Thus, an outer shell is hollowed to snugly engage the inserted weights, with the weights thereafter being immobilized therein. With solid sections being attached, such as with a screw connection, means are required to ensure that the sections do not loosen or move relative to each other.

DETAILED DESCRIPTION OF THE DRAWINGS AND THE PREFERRED EMBODIMENT

With reference to the drawings (elements of like configuration in the drawings have the same reference numerals), in all the embodiments, the putter head 11 (11') is shown as being comprised of two end portions, defined as the heel 15 and toe 16. The heel 15 is the end toward the player at address position (and adjacent the shaft, when positioned in aperture 22, or 22'), with an overall individual length of up to about 22% of the overall length L. In FIGS. 1–4, the putter face 13 is a convex area extending longitudinally over the entire length L of the head 11, with a subtended arc length of 90 degrees, 45 degrees to both sides of the center C of face 13.

In the embodiments of FIGS. 1–4, the putter body 12, is cylindrical in shape and not larger in diameter than about 80% of the diameter of a golf ball 30. In the embodiments of FIGS. 1– 3*a*, the body 12 generally contains hollowed out cavities 18, cylindrical in shape, coaxial with longitudinal axis 25 which extends from the heel 15 to the toe 16 through the center of the putter head 11. These cavities 18 consist of varying, increasing diameters, with the smallest diameter cavity 18*a* at the center of the head and the greatest diameter 19 at the heel 15 and toe 16 of the putter head 11.

With the putter 11 viewed as two halves, separated by axis 26, the tiered cavities 18 in each half are symmetrical and produced by following an identical drill pattern (in the original solid plastic cylinder of body 12) from the heel 15 and the toe 16 of the head body 12. The drill pattern start with the smallest diameter 18*a*, at the deepest depth, at half of overall length L, and increases in diameter at decreasing depths (towards the ends). The depths and diameters of the cavities 18 are determined by calculations using the volume of the cavities 18, the density of lead and the density of the material the head body 12 is constructed of, to calculate the desired putter head weight. The drill pattern should take into account the need to keep a space in the outer cavity 19, at the ends of the head body 12, free for the insertion of stainless steel end caps 21, having a width equal the space left free and of the same diameter as cavity 19, over the lead insert slugs 20. These end caps 21 provide additional weight and add to the aesthetics of the head ends.

The same drill pattern used in the head body 12, minus a length of cavity 19, may be used to create a mold, to accept molten lead, to create two slugs 20 for insertion into the heel 15 and toe 16 of the putter head. It is desirable, with the calculations of the tiered cavities 18, diameters and lengths, to assure that more than 50% of the mass is concentrated in the heel 15 and toe 16 of the putter head. This mass concentration of greater than 50%, in the heel 15 and toe 16 of the head body 12 greatly increases the rotational stability of the putter head 11 throughout the swing and upon impact with a golf ball. Another preferred aspect of the weight distribution, is that a major area 17 of the overall length L, central to the putter head face 13, is created in which the mass is significantly reduced in comparison to the mass in the heel 15 and toe 16 of the putter head 11. This has the effect of creating a sufficiently large "sweet spot", approximately equal to the diameter of a golf ball. The sweet spot, an area defined as a golf ball radius to either side of the center C of the face, will have the properties so as to minimize lateral dispersion and create maximum energy transfer to a golf ball struck at any point in this area.

The cylindrical body configuration and an axially even cylindrical weight distribution, allows for a center of mass CM which is located at the center of the putter head not only along a longitudinal axis 25 but also axially centered in the putter head 11 itself. This alignment of the center of mass CM and the center C of the putter head face 13 ensures maximum energy transfer at the time of impact with a golf ball. In contrast to prior art golf putters, the axially even cylindrical weight distribution allows the weight to be increased symmetrically and coaxially along the central axis 25 outward toward both, the heel 15 and toe 16 and away from the center of mass CM. This weight distribution creates a putter head with reduced lateral dispersion and increased moment of inertia because all putter head weight is centered about and extends proportionally outward in a 360 degree radius away from the common axis 25, while also increasing the mass proportionally outward toward both the heel 15 and toe 16 and away from the center of mass CM.

The putter head includes a shaft mounting hole 22, which is drilled from the top surface 14 of the putter head 11, perpendicular to the longitudinal axis 25 and off center toward the heel 15 of the putter head 11. The distance off center determines the range of lie angles which may be used when shafting the putter head. A shaft 30' of lightweight, malleable material, is used to allow for the alignment of the central axis of the shaft with the center C and the center of mass CM at varying lie angles. Lead which is removed from weight 20 in heel 15, along the shaft insertion hole 22, is also removed from the weight 20 in the toe 16 of the putter head 11, prior to insertion, to maintain perfect symmetry and balance. The shaft tip is of lightweight material and has a negligible effect on center of mass calculations.

With a properly aligned shaft, the putter head 11 will maintain a rest position horizontal to the ground when the club is balanced at a point on the shaft. The absence of a shaft engaging hosel allows for a true, symmetrically balanced putter head 11. The proper shaft alignment, in conjunction with the head configuration and structure virtually eliminates any rotation of the head, upon impact with the golf ball.

As shown, the putter head 11 includes a milled groove 23 on the top, and center of the putter body 12 which is parallel to axis 26 extending though center of mass CM and center C. The groove 23 is filled with a highly visible substance, e.g., white paint, to aid in the alignment of the putter head face 13 with a golf ball and the desired path of travel. To avoid weight disparity, groove 23 should not have a depth in excess of about 0.1" in the top 14 of the putter head.

Figure 1:
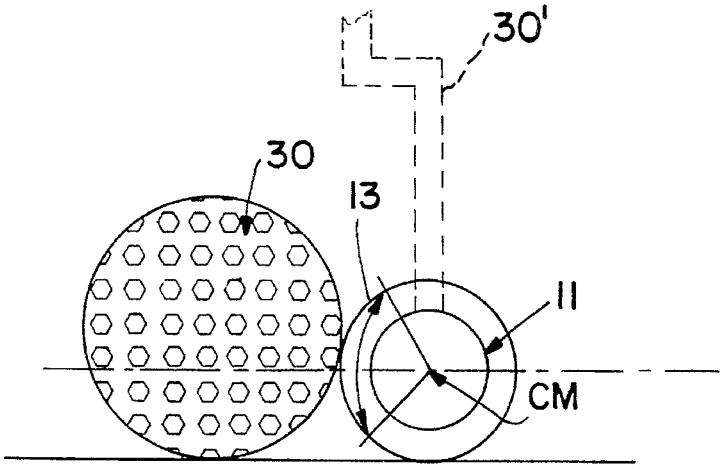
FIG. 1 depicts an end view of the cylindrical golf club head of the present invention relative to a golf ball during putting.
Figure 2:
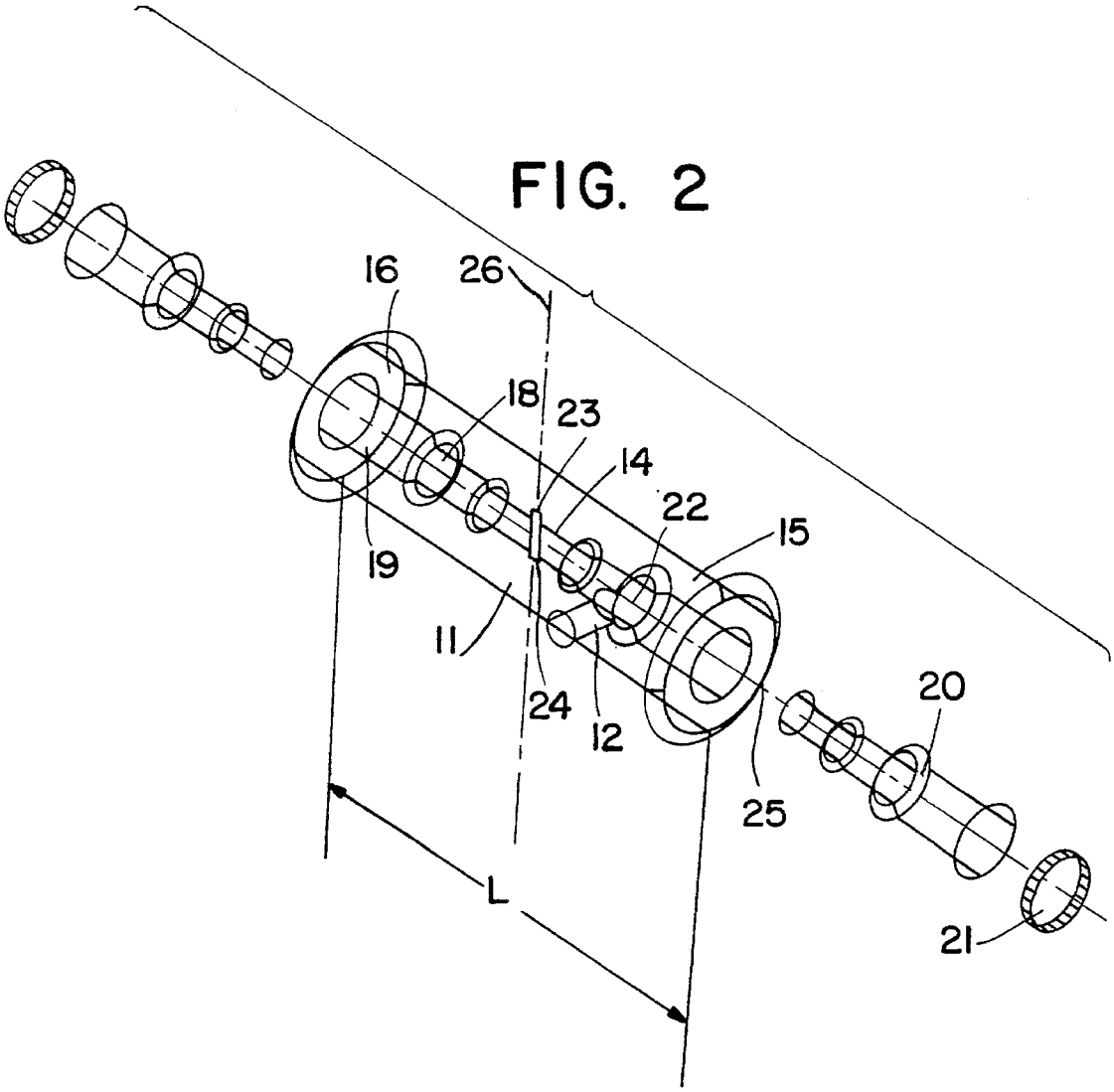
FIG. 2 is an exploded isometric section view of the components of the golf club head of FIG. 1.

In order to effectively use a convex ball striking surface which will impart the maximum rotation on the golf ball from the point of impact, the diameter of the putter head 11, as shown in FIG. 1, is less than 80% of the diameter of a golf ball. This assures that the golf ball is initially struck at a point below the equator of the golf ball 30. This has the effect of creating a true roll when the initial contact with the golf ball 30 is made at the apex of a pendulum swing motion and is further enhanced by an area of multiple contact points during the follow through as the golf ball rolls off the arc of the putter head face 13 in a direction toward the hole. This serves to eliminate the ground friction variable in creating the roll, which can cause skipping, alter the path of the golf ball and vary the distance the golf ball will travel.

In the embodiment shown in FIG. 4, end weight distribution is effected in head 11, by constructing the head with solid stainless steel cylindrical ends 15' and 16' which comprise the heel and toe respectively, attached to solid titanium center section 17' via integrated bolt elements 40, inserted into corresponding threaded holes 41 (bolt and hole placement can be reversed, if desired). Frictional shims 42 or similar elements provide a means for maintaining the threaded engagement between the parts without reversal.

If desired, the head 11' may be provided with a flat striking surface 13' as shown in FIG. 5, wherein a square shaped plastic shell 12' is cored for insertion of a corresponding shaped and weighted lead slug 20'. As shown, portions of the slugs facing the corners of the square are slightly flattened to compensate for the additional weight of the plastic corners **12*a'*–12*d'***, whereby circumferential cross section weight remains constant. Alternatively, because of the very small weight involved, the additional plastic corner weight may be discounted.

The principles and embodiments of the present invention have been disclosed and described in the preceding specification. While it is intended for this present invention to be herein protected, it should not be construed as limited to the particular forms disclosed in this invention, since they are to be interpreted as illustrative rather than restrictive. Variations may easily be accomplished by those skilled in the art without deviating from the scope of the invention, as defined in the following claims.

What is claimed is:

1. A golf putter head having an elongated configuration with a longitudinal central axis therethrough, wherein the weight distribution of the golf club head, at substantially all axial cross sectional positions thereof, is substantially concentrically evenly distributed around said axis and, wherein the golf putter head is comprised of a center element attached to two externally exposed weighted ends forming part of said elongated configuration, said ends being of substantially equal weight, whereby the golf putter head is centrally balanced along said longitudinal axis and centrally along radial axes perpendicularly passing through the longitudinal axis at the center thereof.

2. The golf putter head of claim 1, wherein said elongated configuration is a cylinder.

3. The golf putter head of claim 2, wherein said cylinder is comprised of three aligned and attached cylindrical metal members, comprising two externally exposed cylindrical end members, which form part of said elongated cylinder configuration, and a cylindrical center member therebetween.

4. The golf putter head of claim 3, wherein said cylindrical center member is comprised of titanium.

5. The golf putter head of claim 4, wherein said end members are comprised of stainless steel and said center member is comprised of titanium.

6. The golf putter head of claim 3, wherein said end members are connected to the center member by threaded connection means.

7. The golf putter head of claim 2, wherein said cylindrical shell further comprises an external indicater marking coincident with the center and adapted to be visible by a user of the golf putter head.

8. A golf putter head having an elongated cylinder configuration with a longitudinal central axis therethrough, wherein the weight distribution of the golf club head, at substantially all axial cross sectional positions thereof, is substantially concentrically evenly distributed around said axis, wherein said head is comprised of an outer elongated cylindrical shell having metal weights contained therein, with said weights being configured and positioned to provide the weighted ends and the central balancing along the longitudinal axis and radial axis, wherein said shell contains two metal weights of substantially equal weight, with each weight being of tiered cylindrical configuration of varying diameters, wherein said weights are aligned with the longitudinal axis and positioned such that the diameter tier of each weight is closes to the respective end of the golf putter head.

9. The golf putter head of claim 8, wherein said shell comprises apertures at the respective ends thereof for insertion of said weights and wherein said apertures are sealed with end caps respectively to prevent removal of said weights.

10. The golf putter head of claim 9, wherein one of said metal weights is adapted for insertion of a golf putter shaft therein and the other of said weights is correspondingly adapted to maintain said substantially equal weight.

11. A golf putter head having an elongated configuration with a longitudinal central axis therethrough, wherein the weight distribution of the golf club head, at substantially all axial cross sectional positions thereof, is substantially concentrically evenly distributed around said axis and, wherein the golf putter head is comprised of two weighted ends of substantially equal weight, whereby the golf putter head is centrally balanced along said longitudinal axis and centrally along radial axes perpendicularly passing through the longitudinal axis at the center thereof, and wherein said elongated configuration is rectangular, wherein said head is comprised of an outer elongated rectangular shell, said shell having metal weights contained therein, with said weights being configured and positioned to substantially provide the weighted ends and the central balancing along the longitudinal axis and radial axes.

12. The golf putter head of claim 11, wherein said shell contains two metal weights of substantially equal weight, with each weight being of tiered cylindrical configuration of varying diameters, wherein said weights are aligned with the longitudinal axis and positioned such that the largest diameter tier of each weight is closest to the respective end of the golf putter head.

13. The golf putter head of claim 12, wherein said shell comprises apertures at the respective ends thereof for insertion of said weights and wherein said apertures are sealed with end caps respectively to prevent removal of said weights.

14. The golf putter head of claim 11, wherein said cylindrical shell further comprises an external indicater marking coincident with the center and adapted to be visible by a user of the golf putter head.

15. A golf putter head having an elongated cylindrical configuration with a longitudinal central axis therethrough, wherein the weight distribution of the golf club head, at substantially all axial cross sectional positions thereof, is substantially concentrically evenly distributed around said axes and, wherein the golf putter head is comprised of a cylindrical element comprised of titanium having two weighted ends, said ends being of substantially equal weight, whereby the golf putter head is centrally balanced along said longitudinal axis and centrally along radial axes perpendicularly passing through the longitudinal axis at the center thereof.

16. The golf putter head of claim 15 wherein said weighted ends are comprised of stainless steel.

* * * * *